United States Patent [19]

Siwinski

[11] Patent Number: 4,777,325

[45] Date of Patent: Oct. 11, 1988

[54] LOW PROFILE CABLES FOR TWISTED PAIRS

[75] Inventor: Paul P. Siwinski, Seminole, Fla.

[73] Assignee: AMP Incorporated, Harrisburg, Pa.

[21] Appl. No.: 59,974

[22] Filed: Jun. 9, 1987

[51] Int. Cl.[4] ..... H01B 11/02; H01B 7/08

[52] U.S. Cl. ..... 174/34; 174/113 AS; 174/117 F; 174/117 AS

[58] Field of Search ..... 174/117 R, 117 F, 117 FF, 174/117 AS, 113 AS, 32, 34

[56] References Cited

U.S. PATENT DOCUMENTS

| | | | |
|---|---|---|---|
| Re. 31,197 | 4/1983 | Cocco | 174/117 F X |
| 3,748,371 | 7/1973 | Krook et al. | 174/70 R |
| 3,775,552 | 11/1973 | Schumacher | 174/105 R |
| 4,012,577 | 3/1977 | Lang et al. | 174/34 X |
| 4,034,148 | 7/1977 | Lang | 174/34 |
| 4,227,041 | 10/1980 | Den et al. | 174/117 F |
| 4,359,597 | 11/1982 | Paquin et al. | 174/34 |
| 4,381,426 | 4/1983 | Cronkite et al. | 174/117 F |
| 4,404,424 | 9/1983 | King et al. | 174/34 |
| 4,404,425 | 9/1983 | Rich | 174/107 |
| 4,467,138 | 8/1984 | Brorein | 174/115 |
| 4,487,997 | 12/1984 | Ditchfield | 174/117 F X |
| 4,628,599 | 12/1986 | Bermier et al. | 29/857 |
| 4,640,569 | 2/1987 | Dola et al. | 339/143 R |
| 4,642,480 | 2/1987 | Hughes et al. | 174/36 X |
| 4,644,099 | 2/1987 | Basconi | 174/117 F |
| 4,663,098 | 5/1987 | Gilliam et al. | 174/36 X |
| 4,680,423 | 7/1987 | Bennett et al. | 174/36 |

FOREIGN PATENT DOCUMENTS

| | | | |
|---|---|---|---|
| 524452 | 5/1956 | Canada | 174/113 AS |
| 2937783 | 3/1981 | Fed. Rep. of Germany | 174/117 FF |
| 142585 | 11/1979 | Japan | 174/117 F |

OTHER PUBLICATIONS

AMP Data Sheet 82-664 (Rev. 3-84) "AMP Ribbon Cable, 0.50 [1.27] Centers".

AMP Catalog 86-780, Issued 9-86, "Network/Premises Interconnection Products for Voice, Power, Data", pp. 47; 61-63.

*Primary Examiner*—Morris H. Nimmo

*Attorney, Agent, or Firm*—Robert W. Pitts

[57] ABSTRACT

A twisted pair flat cable suitable for use in undercarpet environments is disclosed. A plurality of twisted pairs are positioned side-by-side, each in separate compartments formed within a hollow envelope of an extruded outer sheath. Separator ribs which do not extend across the entire height of the sheath prevent lateral movement of twisted pairs out of their respective compartments. By cutting the outer sheath at only one location, the outer sheath can be folded back to deploy the twisted pairs for termination. Laterally adjacent solid members suitable for withstanding compressive loads can be employed with a centrally disposed sheath.

10 Claims, 6 Drawing Sheets

LOW PROFILE CABLES FOR TWISTED PAIRS

BACKGROUND OF THE INVENTION

1. Field of the Invention

This invention relates to flat cables for the distribution of electrical signals and more particularly to twisted pair flat cables used for the distribution of telecommunications signals in cables which may be positioned under a carpet in an office or other building requiring numerous wiring changes.

2. Description of the Prior Art

Multiconductor flat cables comprising a plurality of separately insulated wires are commonly disposed within an outer insulating jacket to maintain the separate conductors in a flat configuration. One conventional means of forming the outer insulative sheath is to extrude an insulative material, such as polyvinylchloride, around a plurality of conductors. For example, telephone cords interconnected to modular telephone plugs are conventionally manufactured by disposing four side-by-side insulated wires or conductors into an extruded outer plastic sheath. In order to terminate such a flat cable, the outer insulative sheath is merely stripped away adjacent the end of the cable to expose the four insulated conductors. Since the four individual conductors are positioned in a side-by-side relationship, it is quite simple to merely cut the outer insulative sheath transversely around the inner conductors at a point spaced from the end of the cable. The portion of the outer sheath adjacent the end is thus severed from the remainder of the outer sheath and can merely be pulled off of the end of the inner conductors.

Some applications require that the inner conductors be formed as pairs, in which each of the two conductors in each pair is twisted about the other along its length. There are several problems or limitations with the use of a plurality of twisted conductors in a flat cable form. Among these limitations is the fact that twisted pair conductors cannot be easily mass terminated because of the random twist of the conductors, thus requiring the ends of the outer insulative sheath to be removed so that the inner conductors can be deployed. One alternative permitting mass termination of twisted pair conductors is to provide spaced sections in which the conductors are side-by-side and not twisted. One example is shown in U.S. Pat. No. 4,034,148. This approach, however, means that the cable is not uniform along its length and can only be terminated at precise designated locations. Of course, such cable can still be terminated by removing the outer insulative sheath from the cable. However, when an outer insulative sheath is extruded around a plurality of twisted pairs with the outer extruded sheath being in contact with the pairs of conductors along their entire length, it becomes difficult to strip and remove the outer sheath from the twisted pairs. For example, if four twisted-pairs are located in side-by-side relation in an extruded outer sheath, it becomes necessary to slit the sheath along each pair of conductors in order to remove the outer insulation therefrom. Such an operation is both time consuming and labor intensive.

A number of techniques have been suggested which would employ laminated outer insulating layers around a twisted pair. Examples of such laminated twisted pair flat cable are U.S. Pat. Nos. 4,034,148; 4,012,577; and U.S. Pat. No. 4,404,424. Laminated flat cables do, however, present certain disadvantages. For example, lamination of flat cable requires an adhesive or bonding operation and, at least over time, adhesives begin to degrade. Such factors can be especially critical in hostile environments such as under the carpet applications in offices or buildings where a large number of wiring changes can be anticipated.

SUMMARY OF THE INVENTION

A flat cable having a plurality of twisted wire pairs suitable for use in telecommunications transmissions has all of the twisted pairs disposed in an outer insulative sheath. A plurality of longitudinally extending compartments or ducts are formed in the outer sheath. Each compartment has a cross-sectional area which is greater than the cross-sectional area of the twisted conductor pair so that the interior of the outer sheath does not conform to the outer surface of the wires comprising each twisted pair. Lateral movement of each twisted pair out of its respective compartment is prevented because of constrictions between adjacent compartments. The height of these constrictions is less than the sum of the outer diameters of the respective conductors. When the twisted pairs are to be deployed for termination, the outer sheath, which is resistant to shearing, can be severed by longitudinally cutting the outer sheath at a single location adjacent the cable end. The outer sheath can then be folded back away from the separate twisted pairs, since the outer insulation does not conform to the outer surface of the wires comprising the twisted pair. It is not necessary to cut or sever the insulation in the immediate vicinity of each separated twisted pair of wires as would be necessary if the insulation were to conform to the surface of the separately insulated wires of the twisted pairs. Furthermore, the wires are constrained so that adjacent twisted pairs cannot overlap, thus eliminating any bulges which might be objectionable for under the carpet installations or might result in damage to the wires.

BRIEF DESCRIPTION OF THE DRAWINGS

FIG. 3 is a sectional view taken along section lines 3—3 in FIG. 1 and showing the different position of the individual wires at section 3—3 when compared to the position of the wires at section 2—2.

FIG. 4 shows a single longitudinal cut in the outer insulative sheath or jacket of the cable.

FIG. 5 shows the outer sheath or jacket folded back to permit access to the twisted wire pairs.

FIG. 6 shows that the individual wires separated where the portion of the outer sheath or jacket which has been folded back has been removed.

FIG. 7 is a view illustrating termination of the insulated wires to a conventional insulation displacement electrical connector.

DETAILED DESCRIPTION OF THE PREFERRED EMBODIMENT

Figure 1:
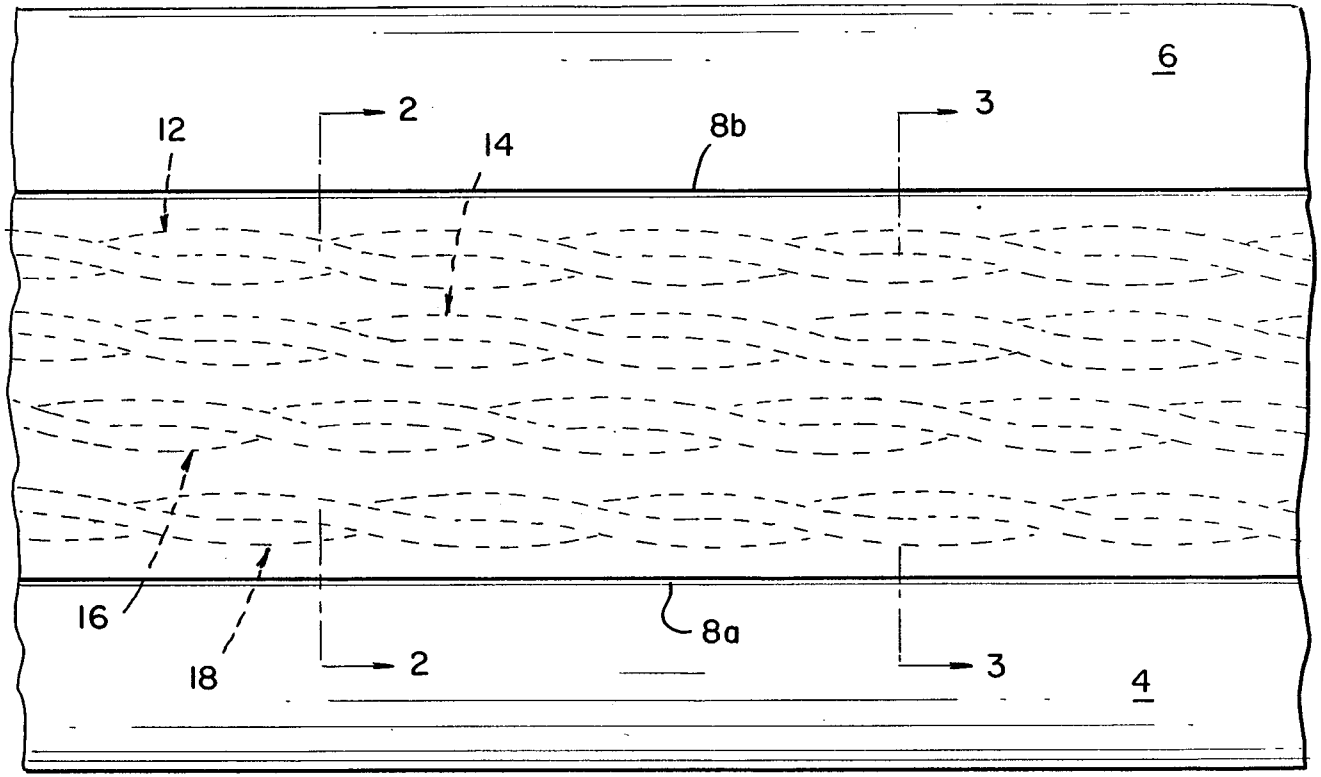
FIG. 1 is a top plan view of a cable showing a plurality of side-by-side twisted pairs.
Figure 2:
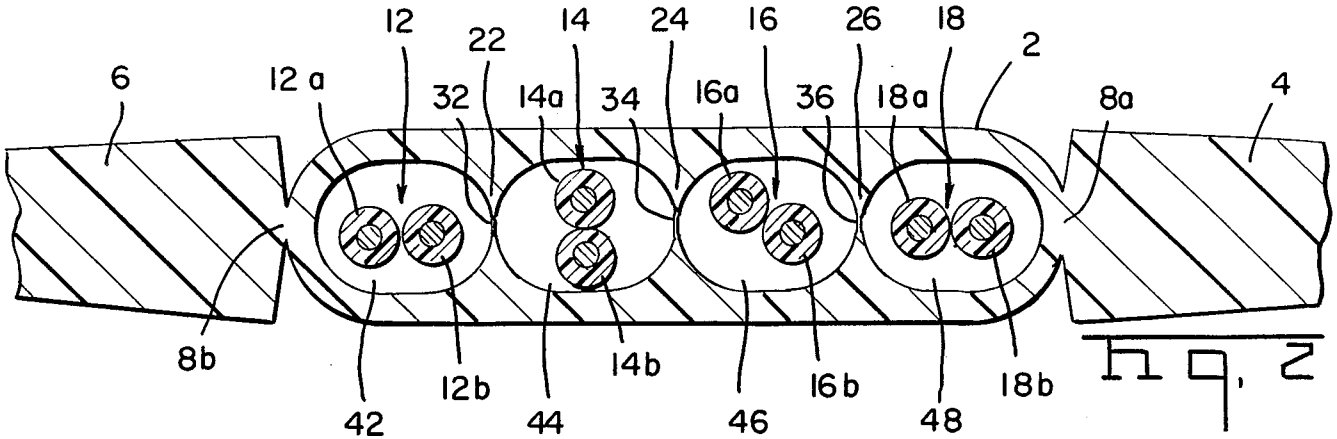
FIG. 2 is a sectional view taken along section lines 2—2 in FIG. 1.
Figure 1:
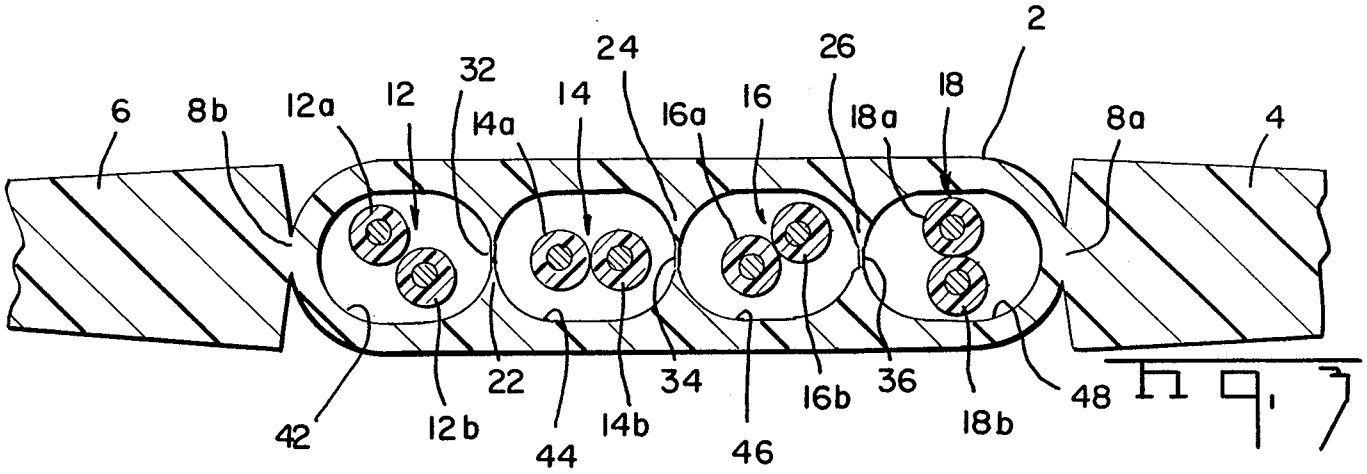

The flat cable depicted herein is suitable for installation in an undercarpet environment where low profile and the contaminant resistance are desirable. The cable comprising the preferred embodiment of the invention is an extruded cable which employs four twisted pairs formed by eight separate wires. It should be understood, however, that other embodiments containing a plurality of twisted pairs could be constructed in accordance with the principles of this invention.

The flat cable is formed by continuously extruding an outer insulative sheath jacket 2 around a plurality of twisted pairs which are fed in side-by-side relationship through an extrusion die. At the same time that the outer sheath 2 is extruded, two laterally adjacent solid members comprising wings or ramps are extruded at opposte edges of the conductive sheath or jacket 2. These two laterally adjacent members 4 and 6 are joined to the edges of the centrally disposed insulative sheath 2 by a thin extruded section 8*a* and 8*b*. Although each of the laterally adjacent members 4 and 6 are tapered toward their free ends, the maximum height of each solid member 4 and 6 adjacent the conductive sheath or jacket is substantially equal in height to the sheath 2. Since the laterally adjacent members 4 and 6 are solid, they would provide greater resistance to compression than the sheath 2 which comprises a substantially hollow envelope. In the preferred embodiment of this invention, the laterally adjacent members 4 and 6 and the centrally disposed insulative sheath or jacket are formed from a common insulative material, such as polyvinylchloride.

The individual conductors, such as conductors 12*a* and 12*b* which form each of the conductors pairs 12, 14, 16 and 18, are positioned generally side-by-side within the outer sheath or jacket 2. Each individual conductor 12*a*, 12*b*, 14*a*, 14*b*, etc. has an inner conductor core surrounded by insulation. These insulated wires are then twisted in a conventional fashion along their length to form twisted pairs. The individual pairs, 12, 14, 16 and 18 are each located within separate compartments 42, 44, 46 and 48 formed on the interior of the substantially hollow envelope of the sheath 2. The cross-sectional area, including the conductive core and surrounding insulation of the two wires forming each twisted pair, is less than the cross-sectional area of each compartment so that the extruded material forming sheath 2 does not conform closely to the outer insulation of the conductors. The conductors forming twisted pairs 12, 14, 16 and 18 are thus free to move about within respective compartments 42, 44, 46 and 48.

Lateral movement of twisted wire pairs, 12, 14, 16 and 18 out of their respective compartments is prevented by longitudinally extending ribs 22, 24, 26 which form constrictions between adjacent ribs. Opposed ribs 22*a* and 22*b*, one located on the top portion of the sheath envelope and the other located at the same position on the bottom surface of the envelope, project inwardly to form these constrictions. The ribs 22, 24, 26 are inwardly projecting parts of the insulative sheath 2 and, in the preferred embodiment, have a substantially triangular cross-section. These ribs 22, 24, 26 have sufficient rigidity to prevent lateral movement of the twisted pairs 12, 14, 16 and 18 out of the respective compartments. Although the ends of the rigid portions defining ribs 22, 24 and 26 are spaced apart by a distance which can be greater than the outer diameter of a single wire, the spacing between opposed ribs is less than the sum of the outer diameter of the two wires, thus preventing lateral movement of the twisted pairs out of its respective compartment. These ribs are formed during the extrusion of the outer sheath 2 and thus comprise longitudinally extending extruded members.

Although the sheath 2 comprises a hollow envelope and is somewhat compressible and flexible, the extruded cross-section of the sheath 2 is substantially constant along the length of the cable. The preferred embodiment of this outer sheath is formed by feeding twisted pairs 12, 14, 16 and 18 through separate cylindrical passages extending through an extrusion die. Since separate cylindrical members are used, thin webs 32, 34 and 36 joining opposed ribs 22*a–b*, 24*a–b*, and 26*a–b* respectively can be formed during the extrusion process. These thin webs 32, 34 and 36 serve no purpose and are so thin that they will not prevent movement of the conductors out of their respective compartmets. Indeed, it would be possible to form the outer sheath 2 and its inner compartments 42, 44, 46 and 48 without the webs 32, 34 and 36. Only the ribs 22, 24 and 26 are capable of preventing lateral movement of the twisted pairs out of their respective compartments.

Figure 4:
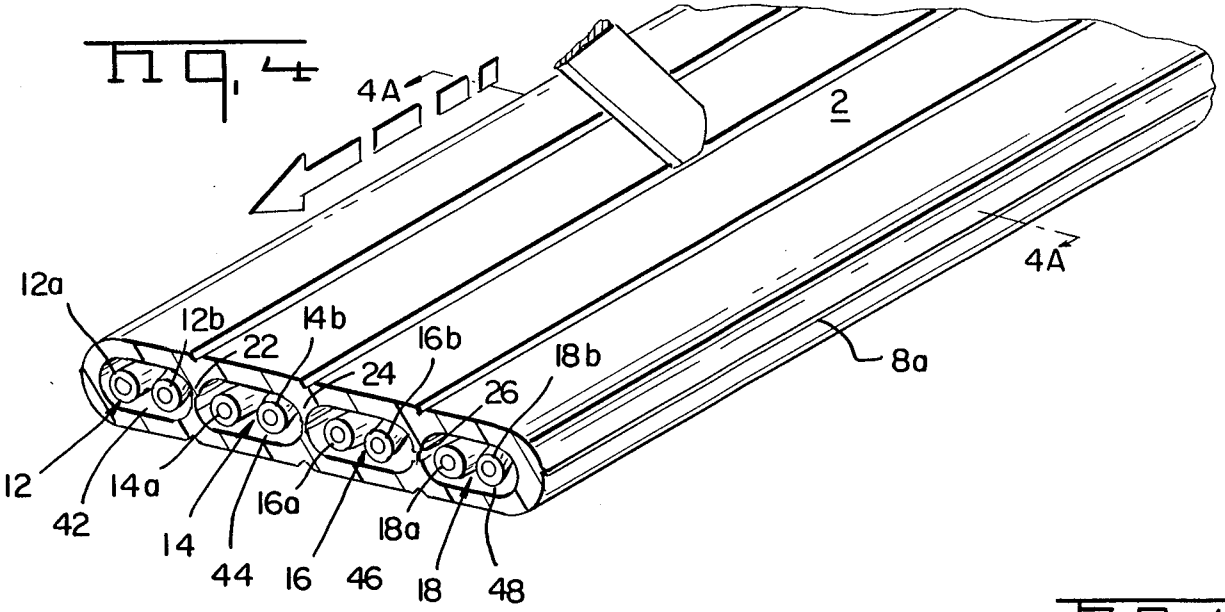
FIGS. 4–7 depict the manner in which the twisted pair conductors can be deployed for termination.
Figure 4B:
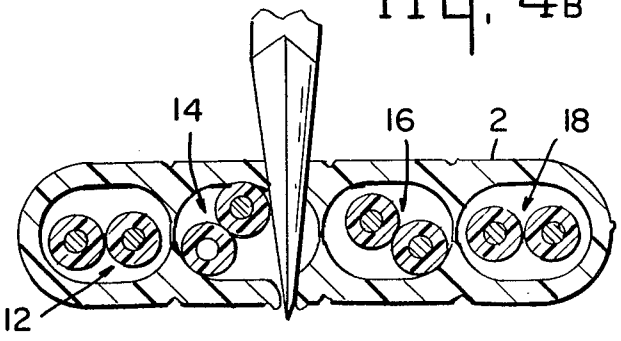
FIG. 4B is a view similar to FIG. 4A but showing a slightly offset cut.
Figure 4A:
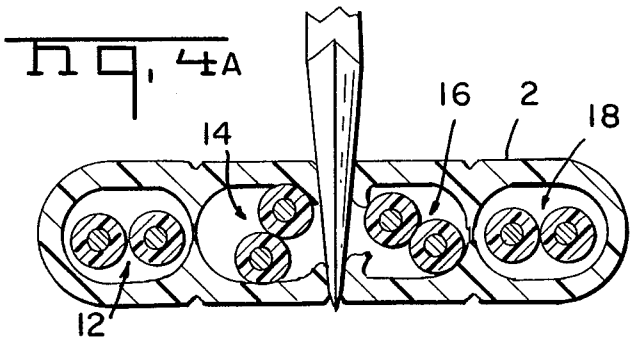
FIG. 4A is a sectional view taken along section 4A—4A in FIG. 4
Figure 5:
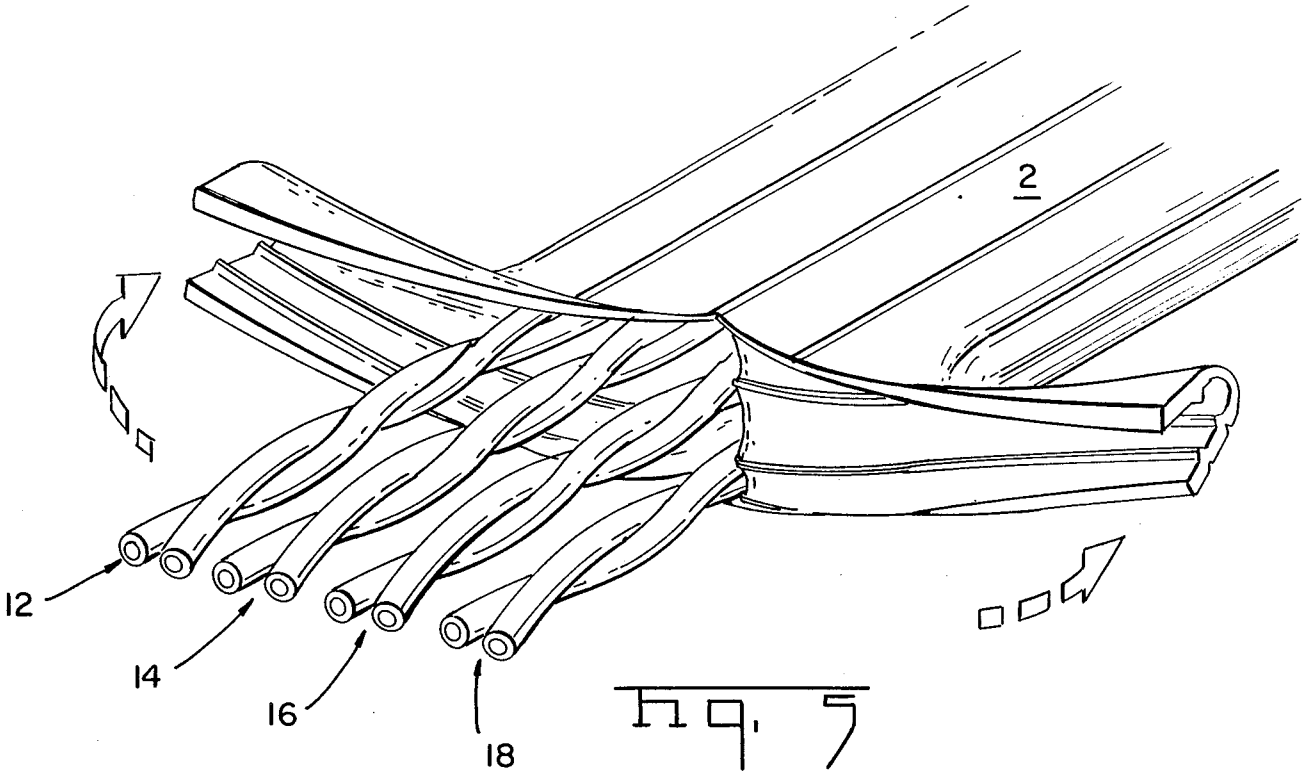
Figure 6:
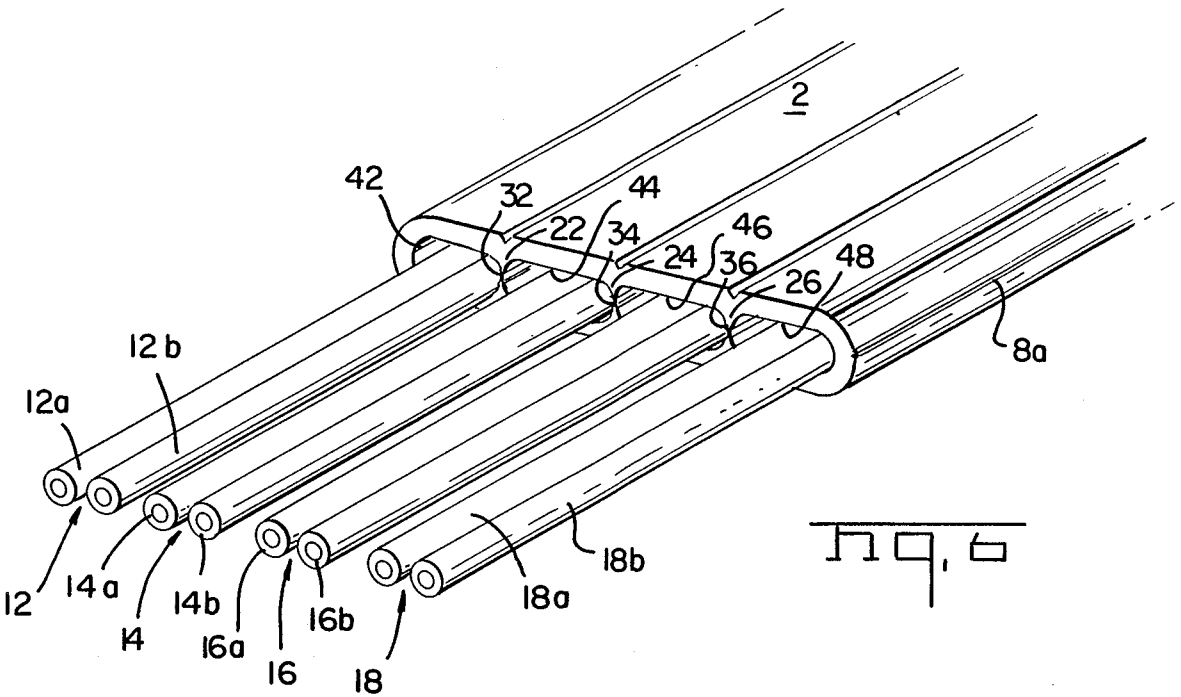
Figure 7:
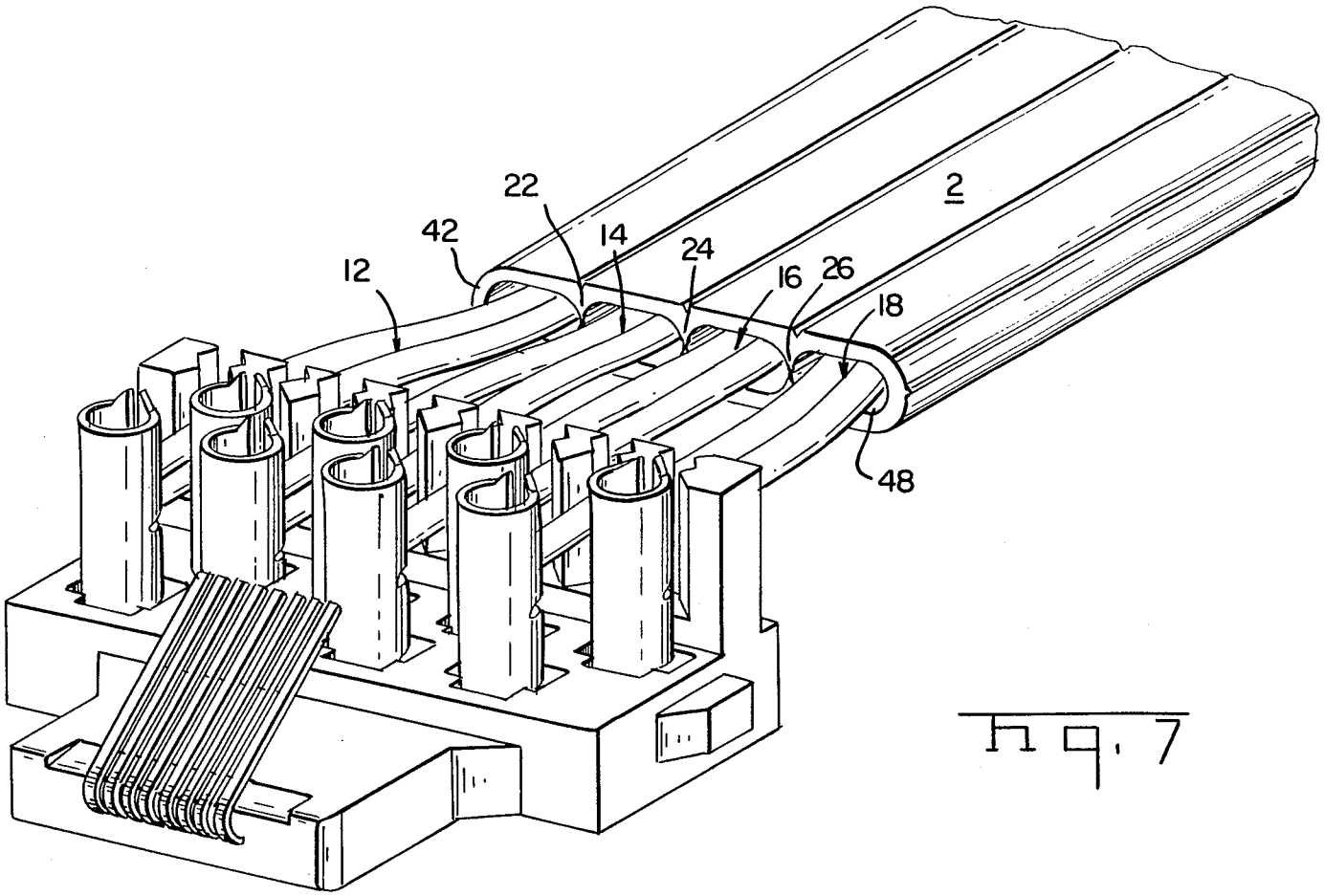

The cable can be easily terminated adjacent its end by making a single longitudinal cut in the outer sheath 2. Normally the cut will be made between adjacent pairs, as shown in FIG. 4A. However, even when the cut is offset, the wires are free to move laterally, as shown in FIG. 4A and, therefore, a pair of wires will simply move to the side so that the blade will not sever the wires forming a twisted pair. Since only the sheath 2 and not the webs 32, 34 and 36 are resistant to shearing, it is only necessary to cut the sheath 2 longitudinally at a single position. After the longitudinal cut is made, the entire outer sheath may be folded back to expose the plurality of twisted pairs, as shown in FIG. 5. Note that the laterally adjacent members 4 and 6 have been previously removed, since the thin longitudinally extending sections 8*a* and 8*b* form convenient tear lines so that laterally adjacent members 4 and 6 can be removed by hand. After the sheath 2 has been folded back, the end portion of the sheath can be removed and the individual conductors 12*a* and 12*b*, etc., can be separated for termination. Once the conductors have been deployed in this manner, they can be easily inserted into insulation displacement terminals in an electrical connector by conventional means. Thus, a low profile cable is fabricated which is easy to terminate and, since the laterally adjacent members 4 and 6 are more resistant to compression than the sheath 2, this cable is especially suitable for use in undercarpet environments where the cable might be subjected to compressive loads. It should be understood, however, that this cable is not limited to use in undercarpet environments, nor in its broadest aspect would it require the use of the laterally adjacent members 4 and 6.

What is claimed:

1. A flat cable comprising:

a plurality of wires arranged as a plurality of twisted pairs, each wire comprising an inner conductive core surrounded by insulation;

an outer insulative sheath surrounding the plurality of twisted pairs, the outer insulative sheath comprising an extruded member having a constant cross-section throughout the length thereof, the insulative sheath comprising a substantially hollow envelope, the insulative sheath including a plurality of longitudinally extending adjacent compartments with a single twisted pair of each adjacent compartment, the cross-sectional area of each compartment being larger than the cross-sectional area of two wires forming the twisted pair, the interior of the sheath being constricted between each compartment such that the sheath prevents lateral movement of each twisted pair from its respective compartment, the outer sheath being resistant to shearing whereby all of the twisted pairs can be freed from the outer sheath by longitudinally cutting the outer sheath at any one position adjacent an end of the cable.

2. The flat cable of claim 1 wherein the constriction between adjacent compartments is formed by at least one longitudinally extending rib, each rib comprising an inward projection of the outer insulative sheath.

3. The flat cable of claim 2 wherein each constriction is formed by two opposed ribs, each rib having sufficient rigidity to prevent lateral movement of each twisted pair from its respective compartment, the ribs being spaced apart by a distance less than the sum of the outer diameters of the two wires forming each twisted pair.

4. The flat cable of claim 3 wherein opposed ribs are joined by a thin web, the rigidity of the thin web being substantially less than that of the ribs, the thin webs having substantially no resistance to shearing, only the ribs having sufficient rigidity to prevent lateral movement of each twisted pair.

5. The flat cable of claim 1 wherein the outer sheath is joined to at least one laterally adjacent member having substantially greater resistance to compression than the outer sheath.

6. The flat cable of claim 5 wherein the laterally adjacent member comprises a solid member and the outer sheath is hollow.

7. The flat cable of claim 6 wherein the laterally adjacent member is joined to the outer sheath by a thin longitudinally extending section comprising a tear line for separating the outer sheath from the laterally adjacent member.

8. A flat cable comprising:

a plurality of wires arranged as a plurality of twisted pairs, each wire comprising an inner conductive core surrounded by insulation;

an outer insulative sheath surrounding the plurality of twisted pairs, the outer insulative sheath comprising an extruded member having a constant cross-section throughout the length thereof, the insulative sheath comprising a substantially hollow envelope including a plurality of longitudinally extending extruded ribs projecting inwardly at laterally spaced positions to define a plurality of longitudinally extending adjacent compartments, one twisted pair being positioned in each adjacent compartment, the cross-sectional area of each compartment being larger than the cross-sectional area of two wires forming the twisted pair, the height of the ribs being sufficient to prevent lateral movement of each twisted pair from its respective compartment, the outer sheath being resistant to shearing whereby all of the twisted pairs can be freed from the outer sheath by longitudinally cutting the outer sheath at any one position adjacent an end of the cable.

9. The flat cable of claim 8 wherein opposed ribs extend inwardly from the top and bottom interior surface of the envelope, each rib having sufficient rigidity to prevent lateral movement of the twisted pairs from their respective compartments, the separation between opposed ribs being less than the sum of the outer diameters of the two wires forming each twisted pair.

10. A low profile cable of the type suitable for installation under a carpet, the cable comprising:

an extruded insulative member comprising a hollow sheath and at least one solid section laterally adjacent the hollow sheath, the maximum height of each solid section being at least equal to the height of the hollow sheath;

a plurality of wires arranged as a plurality of twisted pairs, each wire comprising an inner conductive core surrounded by insulation, the twisted pairs being positioned side-by-side within the sheath;

the insulative sheath comprising a substantially hollow envelope including a plurality of longitudinally extending extruded opposed ribs projecting inwardly at laterally spaced positions to define a plurality of longitudinally extending adjacent compartments, one twisted pair being positioned in each adjacent compartment, the cross-sectional area of each compartment being larger than the cross-sectional area of two wires forming the twisted pair, the opposed ribs being spaced apart by a distance less than the sum of the outer diameters of the two wires forming each twisted pair to prevent movement of the twisted pairs from their respective compartments, only the outer sheath being resistant to shearing whereby all of the twisted pairs can be freed from the outer sheath by longitudinally cutting the outer sheath at any one position.

* * * * *